United States Patent [19]

Mitsuhashi et al.

[11] 3,982,216

[45] Sept. 21, 1976

[54] ELECTROMAGNETIC COORDINATE SWITCHING DEVICE

[75] Inventors: Sadayuki Mitsuhashi; Norio Suzuki; Kazuyoshi Nago, all of Tokyo, Japan

[73] Assignee: Nippon Electric Company, Ltd., Tokyo, Japan

[22] Filed: Sept. 9, 1975

[21] Appl. No.: 611,767

[30] Foreign Application Priority Data

Sept. 9, 1974 Japan ..... 49-103588

[52] U.S. Cl. ..... 335/112; 335/152

[51] Int. Cl.[2] ..... H01H 67/14

[58] Field of Search ..... 335/111, 112, 152

[56] References Cited

UNITED STATES PATENTS

| | | | |
|---|---|---|---|
| 3,487,344 | 12/1969 | Takamura et al. | 335/112 |
| 3,868,610 | 2/1975 | Salam | 335/112 |
| 3,900,807 | 8/1975 | Hamada et al. | 335/112 X |

*Primary Examiner*—George Harris

*Attorney, Agent, or Firm*—Sughrue, Rothwell, Mion, Zinn and Macpeak

[57] ABSTRACT

A divisional excitation type coordinate switching device featuring a single magnetic shunt plate and preformed elongate excitation coils arranged on the top and bottom sides thereof and each surrounding a row or column of switching elements. Terminal blocks are secured to the four sides of the shunt plate, enabling arrangement of component parts in a fully developed formation. Outstanding among the advantages gained are substantial reduction in winding cost and overall size, ease of assembling and improved operational reliability.

9 Claims, 11 Drawing Figures

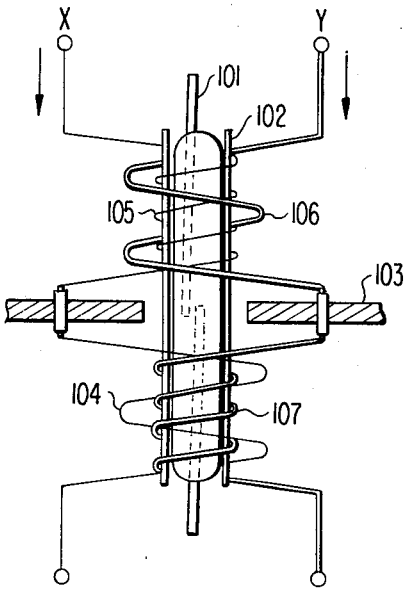
FIG. 1a
FIG. 1b
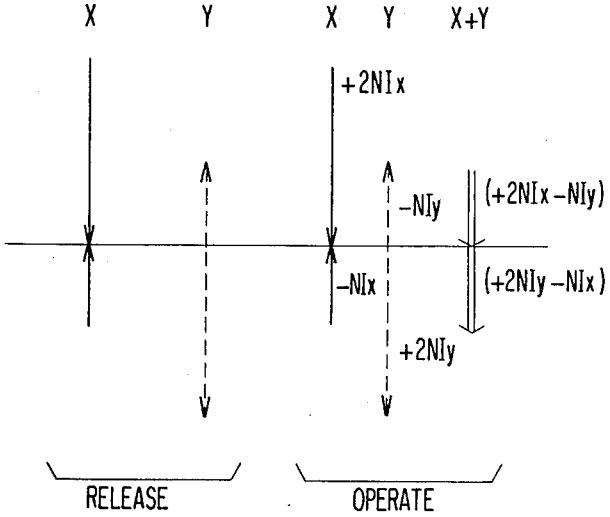
FIG. 2
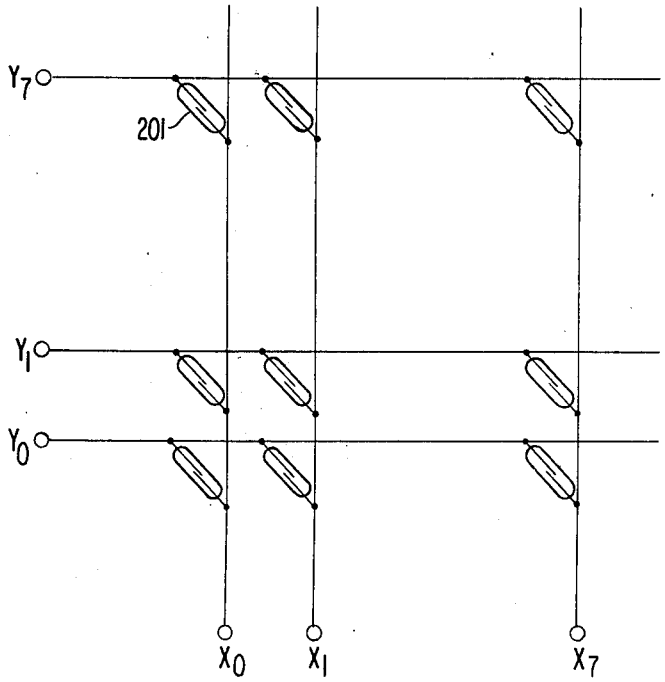

ELECTROMAGNETIC COORDINATE SWITCHING DEVICE

BACKGROUND OF THE INVENTION

This invention relates in general to electromagnetic coordinate switching devices and more particularly to those of the type including a magnetic shunt plate or plates, an array of magnetically responsive switching elements inserted in said shunt plate in rows and columns at respective points of intersection of row and column signal lines extended substantially at right angles, and excitation coils or windings applied to the switching elements. As is well known, this type of electromagnetic coordinate switching device is well suited for use as a speech-path switching network in an automatic telephone exchange, a hybrid electronic computer or the like apparatus, and the present invention is particularly concerned with improvements in construction of the type of coordinate switching device.

Electromagnetic coordinate switches of the general type including switching elements arranged in rows and columns are known in the prior art as exemplified by a technical article entitled "The Ferreed" and published in the *Bell System Technical Journal*, Vol. 43, No. 1 (January 1964). As disclosed therein, each of the switching elements used includes a hollow dielectric spool molded into a shunt plate and extending on both sides therefrom at right angles thereto, at least one reed switch and magnetic core means disposed within the spool, and a plurality of pairs of windings wound around the spool on the top and bottom sides of the shunt plate. In this form the spools of the switching elements in each row and column must be spaced sufficiently from each other to permit a winding bit, in forming each of the windings on the individual spools, to pass freely around the latter without damaging adjacent windings. In space division electronic switching systems, coordinate switches, which provide for the selection of speech paths, constitute about sixty percent of the whole apparatus. Therefore, not only are the magnetic switches important in the functioning of the system but their bulk, weight and cost are critical factors in the economy of the entire switching system.

As described above, the excitation coils are conventionally formed on each of the spools mounted on the shunt plate, making it difficult to reduce the spacing between switching elements in attempting to reduce the size of the coordinate switch. Under this situation, formation of windings having any increased number of turns on the individual spools is troublesome and hardly practicable because the separate spool configuration involves a substantial increase in winding time and hence in fabrication cost of the switching device. However, it is desirable to increase the number of turns of the windings because this allows a reduction in the driving power required to operate the switches. It has further been found that it is extremely difficult to decrease the magnitude of driving current while using high-speed solid state circuits for the driving of such electro-magnetic coordinate switching device.

To cope with these difficulties, a coordinate switching device, including improvements in coil configuration and in aligned formation of crosspoints, has been proposed in the U.S. Pat. No. 3,487,344 issued to Takamura et al. on Dec. 30, 1969. Here sets of crosspoints, each including a plurality of crosspoint elements, are fixedly arranged on respective elongate magnetic shunt plates and are wrapped with primary windings. The shunt plates are arranged parallel to each other to form respective columns of crosspoints and thereafter, secondary windings are applied to the respective rows of crosspoints, each surrounding all the crosspoints in the associated row as a winding common to such crosspoints.

Further, with this arrangement, featuring a segmental array formation and secondary windings common to respective rows of crosspoints, since selection of the crosspoints is effected by coincidence of the direction logic of magnetic fields applied, as will be described later, two sets of excitation coils arranged in rows and columns are energized at the same time to produce a magnetomotive force of substantial magnitude as required for the closing of a switching element selected. This involves a material rise in coil impedance, having a tendency to cause increase the magnitude of the driving power required for the operation of the system.

Further with this arrangement, when only excitation coils associated with row control lines or with column control lines are energized, all the switching elements are opened. Accordingly, when a switching element at any crosspoint is operated to close, the switching elements in the same row and column are all automatically opened and this makes multiple connection of the switching elements in any particular row or column impossible.

Moreover, in previous forms of coordinate switching device, cores of semihard magnetic material are required at the respective crosspoints as means for magnetically holding the switching elements and fitted in the coil spools. Insertion of the cores in the respective coil spools, however, can hardly be automated as the cores must be combined preliminarily with the respective associated switching elements. A further difficulty encountered in the prior art is that the wrapping connection of input and output lines to the coordinate switching device has made its maintenance rather difficult.

SUMMARY OF THE INVENTION

In view of the above-described difficulties involved in previous forms of electromagnetic coordinate switching device, an object of the present invention is to simplify the construction of switching devices of the type concerned and facilitate automation of the assembling operation by arranging component parts in a developed formation. A further object is to reduce the cost percentage of the windings and minimize the size and weight of the whole array while improving its operational capabilities.

According to the present invention the foregoing and other objects are attained by providing a divisional excitation type coordinate switch, comprising a single magnetic shunt plate having an array of through apertures formed at respective crosspoints of the rows and columns of a lattice coordinate. Switching elements are inserted in the respective through apertures in the plate. Elongated second and third excitation coils that surround in common all of the switching elements in each column and row, respecrtively, which are disposed on the top and bottom sides respectively of plate. Elongated first and fourth excitation coils also surround in common all of the switching elements in each row and column, respectively, on the top side of the second excitation coils and on the bottom side of the third excitation coils respectively. Magnetic shield plates are disposed between each two adjacent first excitation coils and between each two adjacent fourth excitation coils. The use of the elongated coils which encompass either a row or a column allows an increase in coil winding with a decrease in switch spacing.

BRIEF DESCRIPTION OF THE DRAWINGS

In the drawings:

FIG. 1*a*, partially in cross section, illustrates the coil configuration employed in a conventional differential excitation switching system;

FIG. 1*b* is a graphical illustration of the electro-magnetic field excitation obtainable with the coil configuration of FIG. 1*a;*

FIG. 2 is a diagrammatical schematic view of the signal lines of an embodiment of the present invention;

DESCRIPTION OF THE PREFERRED EMBODIMENTS

Figure 3:
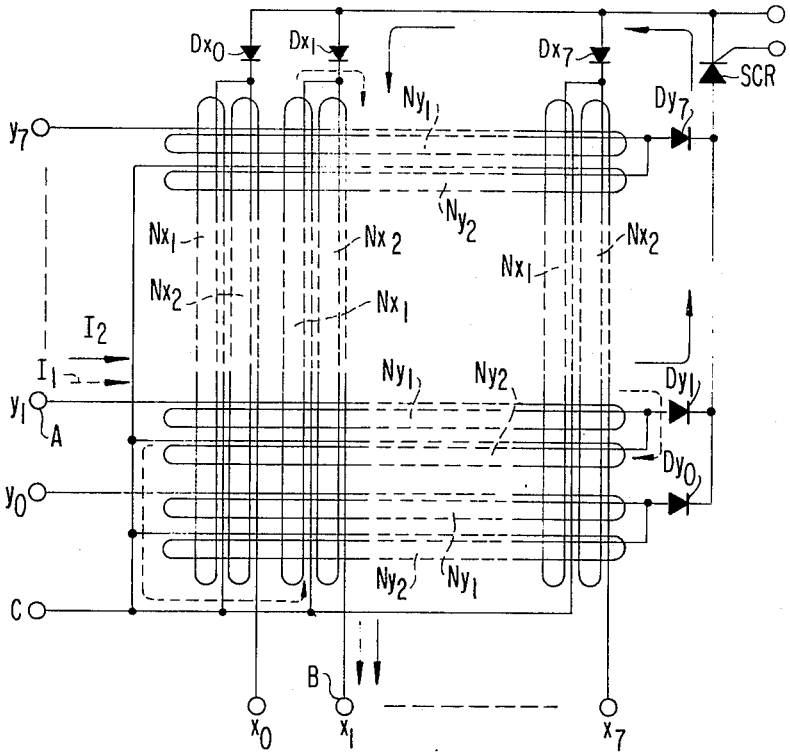
FIG. 3 is a circuit diagram showing the arrangement of control lines of the switching device embodying the present invention.

Referring now to the drawings wherein like numerals designate identical parts throughout the several views and more particularly to FIG. 1*a* wherein reference numeral 101 indicates a reed switch surrounded by magnetic cores 102 of semihard magnetic material in sheet or rod form. A magnetic shunt plate 103 formed of a magnetic material, enables magnetization of magnetic cores 102 in opposite directions. Wound around the magnetic core 102 are several coils; a first excitation coil; 104, a second excitation coil 105 wound with twice as many turns as first coil 104 in an opposite direction and connected in series therewith. Additionally, a third excitation coil 106 is connected in series with a fourth excitation coil 107 which is wound with twice as many turns and in a direction opposite to the third excitation coil 106.

As shown in FIG. 1*b* when current is conducted either through an X line, including first and second excitation coils 104 and 105, or through a Y line, including third and fourth excitation coils 106 and 107, the associated, magnetic cores 102 are each magnetized in opposite directions on the opposite sides of the shunt plate and the reed switch 101 is opened as its contacts are subjected to the magnetic fluxes of opposite polarity. Next, when the X and Y lines are energized simultaneously, (X+Y in FIG. 1*b*), the reed switch 101 is closed as the upper and lower portions of magnetic cores 102 are magnetized in the same respective direction which is that of the second and fourth excitation coils 105 and 107, due to their having numbers of turns twice as large as those of the first and third excitation coils 104 and 106, respectively.

Referring next to FIG. 2, which illustrates the arrangement of signal lines in a magnetic coordinate switching device of the present invention, reference numeral 201 indicates switching elements having a magnetic self-holding function and arranged at the point of intersection of "row" signal lines $Y_0, Y_1, \ldots, Y_7$ with "column" signal lines $X_0, X_1, \ldots, X_7$ extending substantially at right angles thereto. It can be seen that only the switch at the intersection of a "row" and a "column" will conduct when a Y and an X control signal is applied.

FIG. 3 illustrates the arrangement in one embodiment of the present invention where the first and third excitation coils $N_{y1}$ and $N_{y2}$ respectively, extend in the direction of "rows" and the second and fourth excitation coils $N_{x1}$ and $N_{x2}$ extending in the direction of "columns." As distinguished from the switch in FIG. 1 the excitation coils $N_{y1}$, $N_{y2}$, $N_{x1}$ and $N_{x2}$ have substantially the same number of turns and are connected to produce magnetic fields in respective selected senses, as will be described later. The controlling of switching elements 201 is effected by these time-controlled magnetic fields produced by the excitation coils. Diodes $D_{x0}, D_{x1}, \ldots, D_{x7}; D_{y0}, D_{y1}, \ldots, D_{y7}$ and a silicon controlled rectifier (SCR) are connected in appropriate senses to the excitation coils, as shown.

Figure 4:
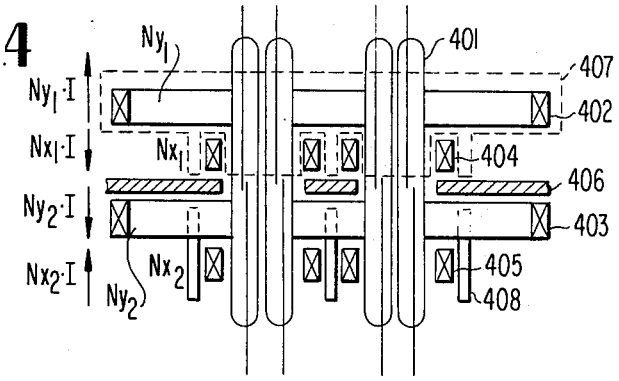
FIG. 4 is a view, partially in cross section, of the crosspoint construction in one embodiment of the present invention.

In FIG. 4, reference numeral 401 indicates switching elements comprised of remanent reed contacts of semihard magnetic material; 402, a first excitation coil wound to surround in common the crosspoints associated with the same row; 404, a second excitation coil wound to surround in common the crosspoints associated with the same column; 403, a third excitation coil wound to surround in common the crosspoints associated with the same row; and 405, a fourth excitation coil wound to surround in common the crosspoints associated with the same column. As shown, the first and second excitation coils are arranged on one side of a magnetic shunt plate 406 while the third and fourth excitation coils are arranged on the other side thereof. Reference numerals 407 and 408 indicate magnetic shield plates arranged between each two adjacent ones of first excitation coils 402 and between each two adjacent ones of fourth excitation coils 405, respectively.

Figure 5A:
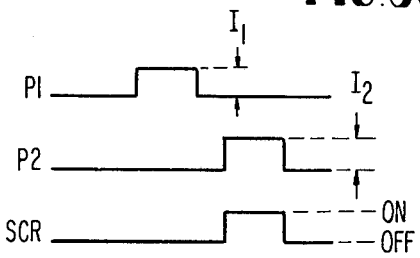
FIG. 5*a* is a graphical view illustrating the timed relationship of control pulses and the short-circuiting switch.

Now, the operation of the electromagnetic switch matrix device shown in FIGS. 2, 3 and 4 will be described with reference to FIGS. 5*a*, 5*b* and 5*c*. In the following description, it is assumed that current pulses indicated at $P_1$ and $P_2$ in FIG. 5*a* are applied, for example, between the terminals A and B in FIG. 3 such that current flows from A to B and that the short-circuiting switch SCR in FIG. 3 is closed for a short period of time in a properly timed relation to the current pulses $P_1$ and $P_2$.

Figure 5B:
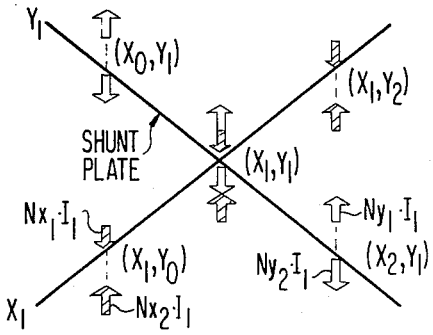
FIG. 5*b* is a diagrammatical view showing the states of excitation at respective crosspoints when control pulse $P_1$ is applied.
Figure 5C:
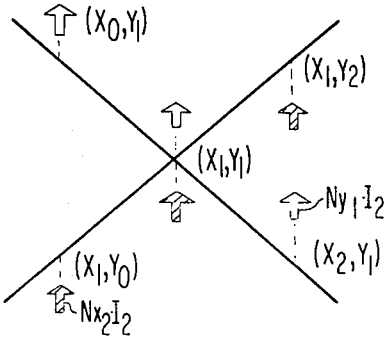
FIG. 5*c* is a diagrammatical view showing the crosspoint of FIG. 5*b* with control pulse $P_2$ applied.

FIG. 5*b* shows the magnetic field states occurring at respective crosspoints when current pulse $P_1$ is applied to flow from terminal A to terminal B. In this condition, the upper and lower portions of the switching element 401 at crosspoints $X_0Y_1$ and $X_2Y_1$, $X_3Y_1, \ldots X_7X_1$, where the first and third excitation coils 402 and 403, connected to the row control lines $Y_1$ are energized, are subjected to respective magnetic fields corresponding to magnetomotive forces $N_{y1}.I_1$ and $-N_{y2}.I_1$, where $N_{y1}$ and $N_{y2}$ represent the respective numbers of turns of the first and third excitation coils, $I_1$ representing the magnitude of current pulse $P_1$ (FIG. 5*a*). Similarly, at crosspoints $X_1Y_0$ and $X_1Y_2, X_1Y_3, \ldots, X_1Y_7$, where the second and fourth excitation coils 404 and 405, connected to the column control lines $x_1$ are energized, the upper and lower portions of the switching element 401 are subjected to respective magnetic fields corresponding to magnetomotive forces $-N_{x1}.I_1$ and $N_{x2}.I_1$, where $N_{x1}$ and $N_{x2}$ represent the respective numbers of turns of the second and fourth excitation coils. In this manner, the upper and lower portions of the switching elements 401 at each of the crosspoints $X_0Y_1$, $X_2Y_1$ $X_3Y_1, \ldots, X_7Y_1$ and $X_1Y_0, X_1Y_2, X_1Y_3, \ldots, X_1Y_7$ are subjected to magnetic fields of the same intensity and opposite in polarity so that the reed contacts of these switching elements are released.

At the selected crosspoint $X_1Y_1$, where all the four excitation coils 402 to 405 are simultaneously energized, the effects of the magnetic fields upon the upper and lower portions of the switching element 401 cancel each other, as seen in FIG. 5*b*, and the state of switching element 401 is left unchanged.

Subsequently, when current pulse $P_2$ is applied to flow between terminals A and B at the same time as the short-circuiting switch SCR is closed, a current is obtained for a short period of time which takes the path including: terminal A — first excitation coil 402 — $D_{y1}$ — SCR — $D_{x1}$ — fourth excitation coil 405 — terminal B thereby eliminating the current flow through the second and third excitation coils, 404 and 403, respectively. FIG. 5*c* shows the magnetic field states obtained at the respective crosspoints with this current. As illustrated, at the crosspoints $X_0Y_1, X_1Y_1, X_2Y_1, \ldots, X_7Y_1$, associated with the first excitation coil 402 connected to the row control line $y_1$, the upper portions of the respective switching elements 401 are subjected to a magnetic field of the intensity $N_{yl}I_2$, while at the crosspoint $X_1Y_0, X_1Y_1, X_1Y_2, \ldots, X_1Y_7$, associated with the fourth excitation coil 405 connected to the column control line $x_1$, the lower portions of the respective switching elements 401 are subjected to a magnetic field of the intensity $N_{x2}I_2$. In this matter, at the selected crosspoint $X_1Y_1$, the contacts of switching element 401 respectively connected with the row signal line $Y_1$ and column signal line $X_1$ are closed under the additive effects of the magnetic fields $N_{y1}I_2$, and $N_{x2}I_2$, respectively, acting upon the upper and lower portions of the switching element 401. However, at the so-called "half-selected" crosspoints $X_0Y_1$, $X_2Y_1$, $X_3Y_1, \ldots$, $X_7Y_1$ and $X_1Y_0, X_1Y_2, X_1Y_3, \ldots, X_1Y_7$, the switching elements 401 are subjected only to one or the other of magnetic fields $N_{y1}I_2$, $N_{x2}I_2$, either of which is not, by itself, effective to actuate the switching elements.

Description will next be made of the construction of the electromagnetic coordinate switching device embodying the present invention with reference to FIGS. 6, 7 and 8.

Figure 6:
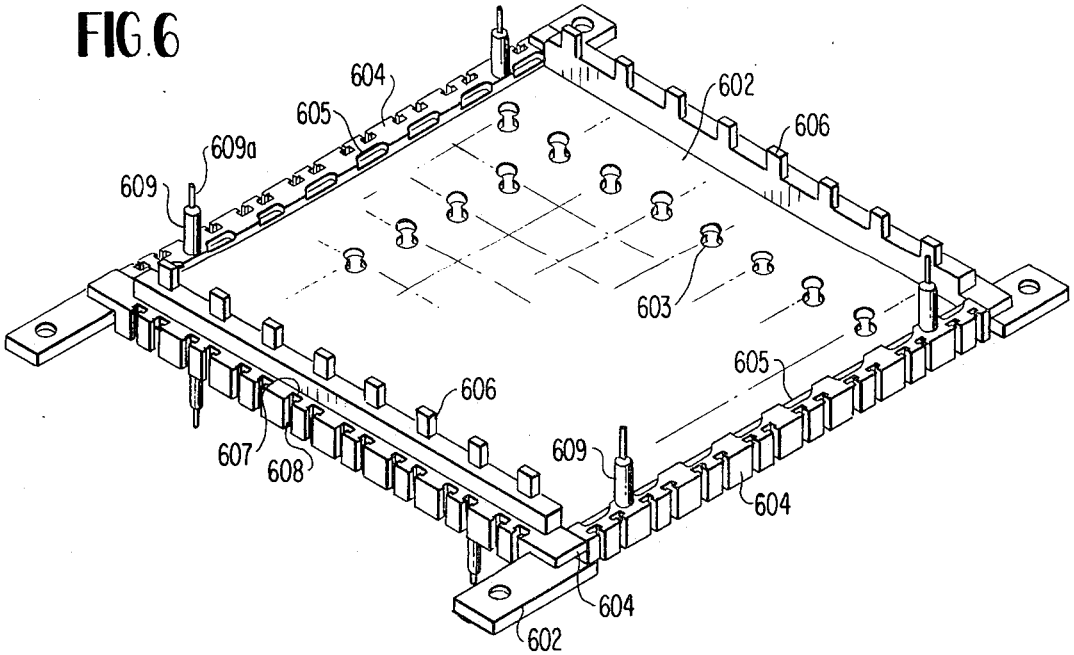
FIG. 6 is an oblique view showing the assembly of a shunt plate and terminal block.

In FIG. 6, reference numeral 602 indicates a shunt plate of magnetic material formed with an array of through apertures 603 at locations corresponding to respective crosspoints of the rows and columns of a lattice coordinate of a desired size. Terminal blocks 604, formed of an appropriate synthetic resin material, are secured to the four sides of the shunt plate 602, respectively, in properly oriented relation thereto. Each of the terminal blocks 604 are formed on one side with recesses 605 to support the adjacent ends of the second or third excitation coils and on the other side with projections 606 to support the adjacent ends of the first or fourth excitation coils. The terminal blocks 604 are also formed with through apertures 607 to be fitted with junction terminals for coil connection and slots 608 communicating with the respective through apertures 607 for insertion of the terminals therein. Reference numeral 609 indicates posts formed on the terminal blocks 604 for fixedly positioning holding bars, which will be described later. The terminal blocks of the configuration described are easy to mold and, the elimination of coil spools such as required in conventional forms of coordinate switching device serves to materially reduce the manufacturing and assembling costs of the device. FIG. 7 illustrates the shunt plate and terminal block assembly of FIG. 6 with excitation coils and magnetic shield plates mounted thereon.

Description will next be made of the manner in which the coordinate switching device of the present invention is assembled, with reference to FIGS. 6 and 7.

Figure 7:
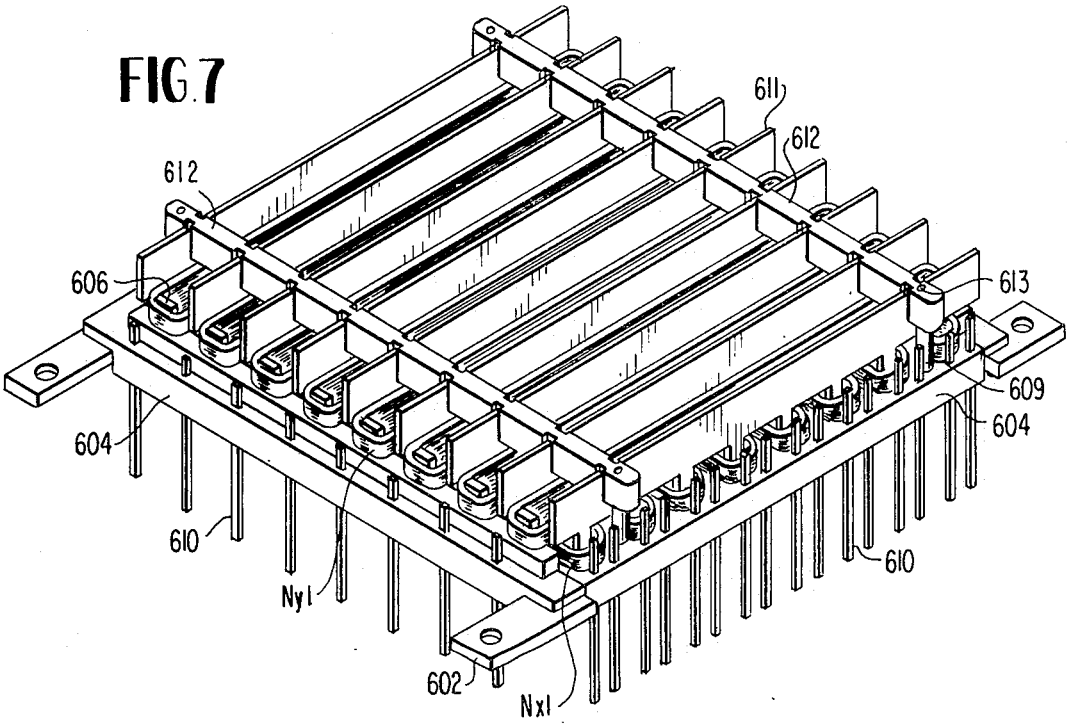
FIG. 7 is an oblique view of the shunt plate and terminal block assembly of FIG. 6 with excitation coils and junction terminals therefor mounted on the assembly.

In FIG. 7, reference numeral 610 indicates coil junction terminals mounted on the terminal blocks 604. The junction terminals 610 are preferably formed of sheet material in sets each including a number of such terminals connected with each other. Each set of terminals 610 are forced sidewise into the through apertures 607, formed in the respective terminal block 604, through the slots 608 and then any extra sheet portions including the web portion connecting the terminals together are severed off.

Excitation coils $N_{x1}$, $N_{x2}$, $N_{y1}$ and $N_{y2}$ are each prepared by winding a copper wire for coil use, for example, of the selfbonding character, into an elongate form properly sized to surround in common all the crosspoints associated with the same row or column and, have substantially the same number of turns. The excitation coils formed in this manner are each arranged to produce a magnetic field in a direction selected to control the switching elements at the associated crosspoints in a predetermined manner. Namely, the second and third excitation coils $N_{x1}$, $N_{y2}$ are arranged on the top and bottom sides of shunt plate 602 so as to produce magnetic fluxes in the same direction while the first and fourth excitation coils $N_{y1}$ and $N_{x2}$ are arranged on the top and bottom sides of the second and third excitation coils $N_{x1}$ and $N_{y2}$, respectively, in a manner so as to produce magnetic fluxes in a direction opposite to that of magnetic fluxes produced by the second and third excitation coils. Further, the second and third excitation coils $N_{x1}$ and $N_{y2}$ are supported with their opposite ends received in the recesses 605, formed in one pair of opposite parallel terminal blocks 604, and the first and fourth excitation coils $N_{y1}$ and $N_{x2}$ are fitted at the opposite ends over the projections 606 formed on the other pair of opposite parallel terminal blocks to be supported thereon.

Unlike the conventional coil arrangement, as in FIG. 1*a* in which windings are formed at each of the crosspoints of the lattice coordinate by means of a winding bit, the invention described above does not need the spacings, previously required between every two adjacent crosspoints, to allow passage of the winding bit. It will be appreciated that this allows a substantial reduction in coil spacing and hence in the size of the switching device, a substantial savings of the labor and cost of winding operation, and substantial increase in operational reliability. Reference numeral 611 indicates magnetic shield plates arranged between every two adjacent ones of the first excitation coils $N_{y1}$ and between every two adjacent ones of the fourth excitation coils $N_{x2}$ to serve to further improve the operational reliability of the device.

Referring again to FIG. 7, reference numeral 612 indicates holding bars formed of synthetic resin material and serving the purpose of holding the excitation coils $N_{x1}$, $N_{y1}$ and the excitation coils $N_{y2}$, $N_{x2}$ in place respectively on the top and bottom sides of the magnetic shunt plate 602 together with magnetic shield plates 611. The holding bars 612 are each formed at the opposite ends with apertures 613 to fit over the reduced top end portions 609*a* of posts 609, formed on either pair of opposite terminal blocks 604, and secured to the posts integrally therewith as by upsetting under heat so as to hold the excitation coils and the magnetic shield plates firmly in place in cooperation with the terminal blocks.

Figure 8:
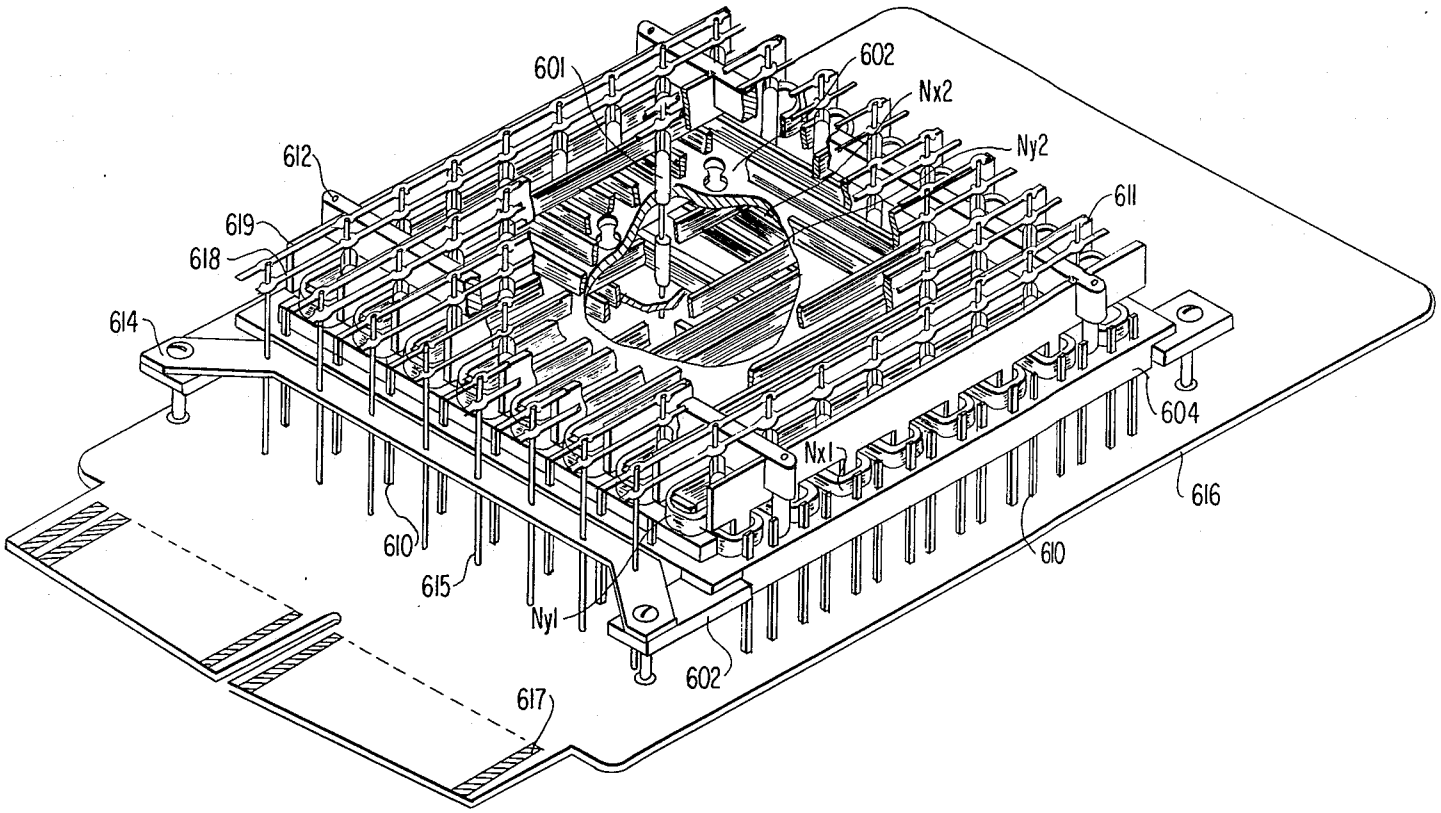
FIG. 8 is an oblique view partly cutaway, showing the completely assembled coordinate switch of FIGS. 6 and 7.

Referring next to FIG. 8, which illustrates the finally assembled state of one embodiment of the present invention, reference numeral 614 indicates a terminal plate of synthetic resin material secured to the magnetic shunt plate 602 along one side thereof and carrying signal terminals 615 at regular intervals. Signal terminals 615 are formed of a sheet material as an integral piece including a set of such terminals joined with each other and corresponding in number to the size of the switching device wherein all the signal terminals in the set are inserted simultaneously through respective apertures provided in the terminal plate 614. On the other hand, the switching elements 601 are inserted through apertures 603 formed in the magnetic shunt plate 602, through the associated row excitation coils $N_{y1}$ and $N_{y2}$ and column excitation coils $N_{x1}$ and $N_{x2}$ with one end terminal fitted into respective apertures formed in a printed circuit board 616. The printed circuit board 616 is formed thereon with part of the wiring network for the control lines and that for row and column signal lines led to one end region 617 of the printed circuit board which is adapted for connector attachment. Soldering operation for securing the switching elements to the printed circuit board is performed with the contact regions of the respective switching elements properly positioned relative to the magnetic shunt plate 602 by appropriate jig means. The extra portion of the integral terminal piece secured to the terminal plate 614 is removed to leave individual signal terminals 615 thereon. For the wiring of the row signal lines, conductors 618 and 619 are employed to connect the signal terminals 615 with the switching elements 601 in the respective associated rows. Therefore during fabrication of the coordinate switching device assembling, wiring and soldering operations can readily be automatized thus reducing the total cost. Further, the arrangement of all the input and output lines collected on the terminal region 617 of printed circuit board 616 allowing quick replacement reduces maintenance cost to a minimum.

In the embodiment of FIG. 8, the magnetic shunt plate 602 fitted with excitation coils and so forth is supported on the printed circuit board 616 through the intermediary of coil junction terminals 610 and signal terminals 615. Incidentally, as a means for time-controlling the magnetic fields developed by the excitation coils, a circuit arrangement including diodes and an SCR may be formed on the printed circuit board 616. Alternatively, any desired form of such switch element as SCR may be provided exteriorly with only the diodes mounted on the printed circuit board.

The above-described embodiment of the present invention and an example of conventional coordinate switching device of the differential excitation type are compared in the following table.

| Item | Embodiment of the Invention | Conventional Example |
|---|---|---|
| Selection method | Divisional excitation | Differential excitation |
| Matrix size | 8 × 8 (2 wire) | 8 × 8 (2 wire) |
| Volume, c.c. | 490 | 730 |
| Weight, gr. | 350 | 750 |
| Drive current, A | 2 (release)<br>2.5 (operate) | 4 (release)<br>4 (operate) |
| Coil: turns | N = 45 | 32 |
| Resistance, Ω | 10 (release)<br>5 (operate) | 10 (release)<br>10 (operate) |
| Drive power, W | 40 (release)<br>32 (operate) | 160 (release)<br>160 (operate) |

It will readily be appreciated that according to the present invention there is provided an electromagnetic coordinate switching device of the divisional excitation type which has many advantages over the prior art, including material reduction in size, weight, initial cost and maintenance. Among others, the use of preformed common excitation coils of elongate form surrounding the switching elements in each row and column, in combination with magnetic shield plates, holding bars serving to hold the excitation coils and magnetic shield plates in place, and terminal blocks enabling arrangement of component parts in a developed formation, enables substantial reduction in fabrication cost of component parts, facilitates their assembling and gives the device an improved operational reliability. The construction and arrangement of the switching device also facilitates automatization of soldering operation with use of appropriate jig means.

Obviously numerous modifications and variations of the present invention are possible in the light of the above teachings. It is therefore to be understood that within the scope of the appended claims the invention may be practiced otherwise than as specifically described therein.

What is claimed is:

1. An electromagnetic coordinate switching device of the divisionally excited type comprising;

a plurality of switching means, each with two ends, having a magnetic self-holding action such that said means conducts only when both ends are in magnetic fields having the same orientation;

a magnetic shunt means having sides, and a top and bottom with through apertures therebetween, said apertures arranged in rows and columns such that the apertures are located at the crosspoints of said rows and columns, at least one of said switching means being inserted in each of said apertures such that a magnetic field at one end of the switch is not felt at the other end;

a plurality of first elongated coil means each having two leads, surrounding each of said rows on the top of said shunt means with a space between said coil means and said shunt means such that a second elongated coil means can be placed therebetween, said first elongated coil means selectively operable to apply a magnetic field simultaneously, in a direction away from said shunt means, to the switching means contained in said row;

a plurality of second elongated coil means each having two leads, surrounding each of said columns, in the space between said first elongated coil means and said shunt means, selectively operable to apply a magnetic field simultaneously, in a direction toward the shunt means, to all of said switching means in said column;

a plurality of third elongated coil means having two leads, surrounding each of said rows on the bottom of said shunt means selectively operable to apply a magnetic field simultaneously, in a direction away from said shunt means, to all of said switching means in said row;

a plurality of fourth elongated coil means each having two leads, surrounding each of said columns on the bottom of said third coil means selectively operable to apply a magnetic field simultaneously, in a direction toward the shunt means, to the switching means contained in said row; and a plurality of magnetic shield means arranged between adjacent first excitation coils and adjacent fourth excitation coils to insulate each coil from any magnetic field caused by adjacent coils.

2. The device of claim 1 which further comprises a set of terminal blocks secured to said magnetic shunt plate along the sides thereof to support said excitation coils at the ends thereof and said terminal blocks having junction terminals for circuit connection of said excitation coils.

3. The device of claim 2, further comprising holding bars for holding said excitation coils and said magnetic shield means in position in cooperation with said terminal blocks.

4. The device of claim 2, further comprising a printed circuit board serving to support said magnetic shunt plate through the intermediary of said junction terminals.

5. The device of claim 1, wherein one lead of each of all said second coil means are connected together and connected to one lead of each of all said third coil means, said other leads of said second coil means are connected to one of said leads of said corresponding fourth coil means located parallel to said second coil means but on the bottom of said shunt means, one leaf of each of all of said first coil means are connected to individual terminals, said other leads of said first coil means are connected to the other of said leads of said corresponding third coil means located parallel to said first coil means but on the bottom of said shunt means, the other of said leads of said fourth coil means are connected to individual terminals.

6. The device of claim 5 comprising in addition:

a short circuit switching means having two current leads and a contact lead to controllably place said means in and out of conduction between said two current leads;

a plurality of row diodes connected between the junctions of said first and third coil means in each row and one lead of said short circuit switching means such that current can flow from said junctions to said short circuit switching means but cannot flow between the junctions of the rows of said first and third coil means;

a plurality of column diodes connected between the junctions of said second and fourth coil means in each column and the other lead of said short circuit switching means such that current can flow into the junctions from said short circuit switching means but cannot flow between the junctions of the columns of said second and fourth coil means.

7. The device of claim 5 wherein said short circuit switching means is a silicon controlled rectifier.

8. The device of claim 7 wherein said plurality of switching means are reed switches inserted in each of said apertures.

9. The device of claim 7 wherein said plurality of switching means are pairs of reed switches inserted in each of said apertures.

* * * * *